US006036363A

United States Patent [19]

Behnk

[11] Patent Number: 6,036,363

[45] Date of Patent: Mar. 14, 2000

[54] HOUSEHOLD REFUSE SORTING DEVICE

[76] Inventor: Florian Behnk, Krieckamp 90, D-22391 Hamburg, Germany

[21] Appl. No.: 09/194,057

[22] PCT Filed: May 20, 1997

[86] PCT No.: PCT/EP97/02554

§ 371 Date: Nov. 20, 1998

§ 102(e) Date: Nov. 20, 1998

[87] PCT Pub. No.: WO97/44267

PCT Pub. Date: Nov. 27, 1997

[30] Foreign Application Priority Data

| | | | |
|---|---|---|---|
| May 22, 1996 | [DE] | Germany | 196 20 530 |
| May 22, 1996 | [DE] | Germany | 296 09 159 |
| Dec. 5, 1996 | [DE] | Germany | 196 50 484 |

[51] Int. Cl.[7] ..... B65D 30/22

[52] U.S. Cl. ..... 383/38; 383/37

[58] Field of Search ..... 383/38, 37; 206/554; 220/495.09, 495.11

[56] References Cited

U.S. PATENT DOCUMENTS

| | | | |
|---|---|---|---|
| 4,480,750 | 11/1984 | Dancy | 206/554 |
| 4,493,419 | 1/1985 | Prader et al. | 206/554 |
| 4,676,378 | 6/1987 | Baxley et al. | 206/554 |
| 4,750,639 | 6/1988 | Schaerer | 383/38 X |
| 4,756,628 | 7/1988 | Branson | 383/38 X |
| 4,759,639 | 7/1988 | DeMatteis | 206/554 X |
| 5,167,342 | 12/1992 | Merritt | 383/38 X |
| 5,265,961 | 11/1993 | Boyd | 383/38 X |
| 5,333,730 | 8/1994 | Boyd | 383/37 X |

FOREIGN PATENT DOCUMENTS

| | | | |
|---|---|---|---|
| 614829 | 9/1994 | European Pat. Off. | 383/38 |
| 2687986 | 9/1993 | France | 383/38 |
| 4037009 | 5/1992 | Germany | 220/495.09 |

*Primary Examiner*—Jes F. Pascua
*Attorney, Agent, or Firm*—Lane, Aitken & McCann, L.L.P.

[57] ABSTRACT

A device for sorting litter, household refuse or the like in a container, a holder device or the like, and for disposing of the refuse separately. The device comprises at least two separably interconnected sack-like chambers which are formed from foil material and are interconnected in their upper regions such that they merge into a common region (2) in the manner of a pair of tights. A gusset (6, 7) is formed in each case between adjacent chambers (3,4).

5 Claims, 1 Drawing Sheet

HOUSEHOLD REFUSE SORTING DEVICE

BACKGROUND OF THE INVENTION

The invention relates to a device for sorting refuse, household garbage, and the like in a receptacle, a holding device, or the like and for separate disposal, having at least two separably interconnected sackshaped sheet plastic compartments.

A device such as this with two or more compartments is known (EP-A-0 614 829), one in which the upper areas of the compartments effect transition to one common area which does not, however, prevent refuse from falling into compartments into which it is not intended to fall.

A device for presorting household garbage is known (DE 36 32 721 A1); in it individual replaceable garbage bags are suspended in a holding device, the garbage bags consisting of at least two separable component bags separated from each other and forming garbage compartments. The bag components are separably connected to each other along their lengthwise edges, and another separable junction point is present in the center where all the component bags come together. A device with three garbage components is thereby formed. Of course, it is not possible with this embodiment to fold the interconnected component bags over the edge of a receptacle or a holding device because the component bags are joined together. Slots or slotlike openings into which garbage can be introduced inadvertently are present in the upper intermediate areas between adjacent component bags.

As they are filled, the bags slide into the container and then can no longer be filled.

A refuse container is also known (DE 40 37 009 A1) in which a cylindrical container is employed which is slotted on its circumference for the purpose of receiving two separate plastic garbage bags at two diametrically opposite points. Two bags can be accommodated in the container, the top edge of the bags being folded over the container. It is, of course, a disadvantage in this instance that a slotlike opening into which garbage may be inadvertently introduced and then collect outside the two garbage bags may be formed in the central area between the top edges of the bags. In addition, the container itself is not suitable for separation and presorting of household garbage without the use of garbage bags. Nor is it designed to be disposed of along with garbage.

SUMMARY OF THE INVENTION

The invention is concerned with the problem of designing a device such as that indicated in the foregoing so that a garbage bag is formed which may be transported as a unit and on the spot folded over the edge of a container or a holding device without the need for procuring a new container. After use the garbage bag may be removed as an individual element and it may then be used for waste disposal. However, separation of the individual compartments of the garbage bags at the separation points provided for the purpose and separate disposal are also conceivable.

The device claimed for the invention is in the form of trousers, that is, an article of clothing serving to cover the hips and the legs, when one assumes a device with two sacklike compartments. A device such as this accordingly has an upper cylindrical area from which the two also cylindrical sacklike compartments extend downward, a gusset, that is, an element connecting the two sacklike components, being formed in the intermediate area. The term "gusset" is used in this sense for this invention in order to express the fact that the sacklike components are joined together at this point, but of course in such a way that they can be separated from each other again at this point. All state-of-the-art processes, especially cementing or bonding together, may be considered as potential joining methods.

In a preferred embodiment the area to which the individual sacklike compartments make a transition is cylindrical or columnar in shape. Other cross-sectional shapes are also possible, of course, such as rectangular cross-sections, specifically when three or more sacklike compartments are to be positioned side by side.

All conceivable plastics may be considered as sheet material, especially ones which spontaneously decompose, but also sheet metal, paper strips, and composite materials.

In manufacture of the preferred embodiment of the device claimed for the invention, the procedure followed is to produce the individual components, that is, the sacklike compartments and the upper area, from flat sheets, which are cut out so that they may be joined together at their edges and in the gusset (intermediate) areas. The connection of the two compartment-like components is subsequently separable, while the connection of the two sheet components forming the compartments need not be separable in the side areas and in the bottom area.

BRIEF DESCRIPTION OF THE DRAWINGS

The invention is described in what follows by way of example with reference to the drawing, in which.

DETAILED DESCRIPTION OF THE PREFERRED EMBODIMENTS

Figure 1:
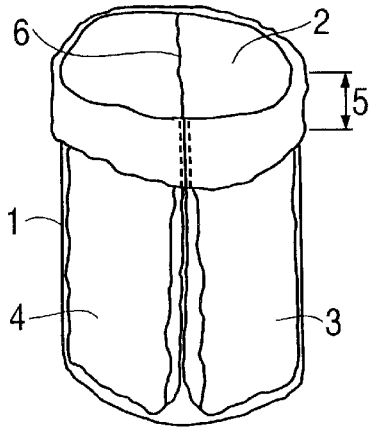
FIG. 1 shows a device as claimed for the invention with two compartments in a receptacle, FIG. 2 the two-compartment bag illustrated in FIG. 1 after unfolding, FIG. 3 the cutout components for manufacture of the two compartment bag claimed for the invention, FIG. 4 the first two widths of one compartment bag, one width being superimposed on the other, FIG. 5 the interior sides of adjacent bags of a two-compartment bag, FIG. 6 the two parts of the other compartment bag, one part being superimposed on the other, FIG. 7 the four side parts shown in FIG. 3, one part being superimposed on another.

A bucketshaped refuse container 1 as shown in FIG. 1 contains an unfolded two-compartment bag 2 consisting of two compartments 3 and 4 which are connected to each other by way of a separating strip or gusset 6. The two-compartment bag is kept in position by the retaining edge or common area 5 folded over the edge of the refuse container 1; this retaining edge can be easily folded over the edge of the refuse container 1.

Figure 2:
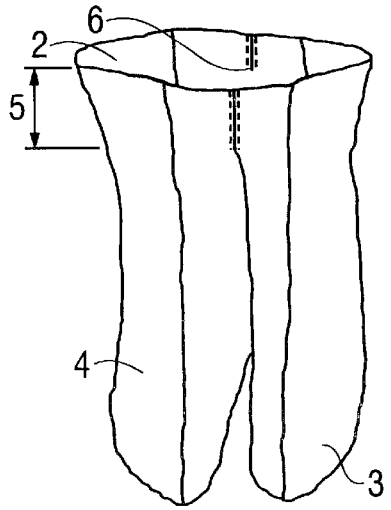

The unfolded two-compartment bag 2 shown in FIG. 2 consists of two compartments 3 and 4, which are joined together by way of a gusset 6 and a funnelshaped retaining edge or common area 5 which is folded upward. FIG. 2 clearly illustrates the design, which is similar to that of a pantyhose.

Figure 3:
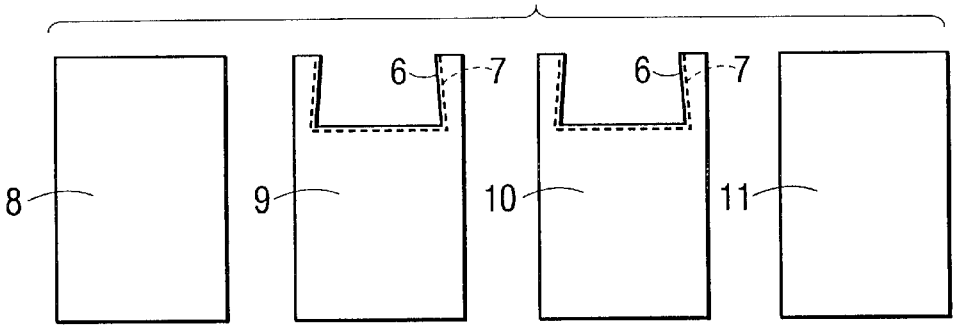
Figure 4:
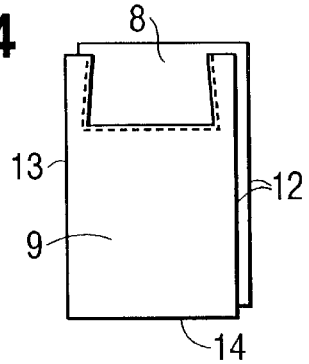
Figure 5:
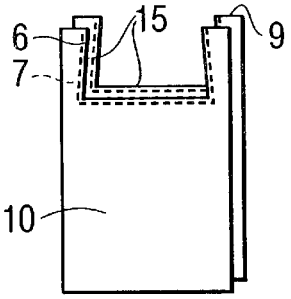
Figure 6:
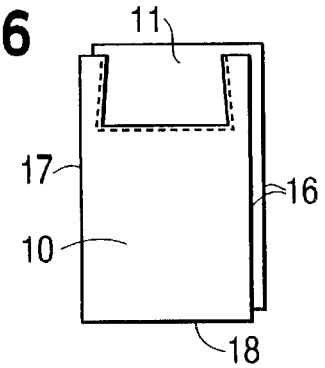

Structural details of the two-compartment bag are to be seen in FIGS. 3 to 7. The two-compartment bag consists of a total of four sides, as is illustrated in FIG. 3, two external sides 8 and 11 and two internal sides 9 and 10, which are characterized by their U-shaped cutout tapering upward which forms the gusset. One external side 8 is folded together and bonded or cemented with an internal side 9, as is shown in FIG. 4, along the two external sides 12 and 13 and the bottom transverse side 14. As is illustrated in FIG. 5, the two internal sides 9 and 10 are cemented or bonded together along the U-shaped cutout tapering upward, the so-called separating strip 15, in such a way that subsequent separation is possible here, or a tear seam 7 extending through both sides 9 and 10 extends parallel to this cemented or bonded seam 6. The other external side 11 is folded together with and cemented or bonded to the other internal side 10, along the two external longitudinal sides 16 and 17 and the bottom transverse side 18, as is illustrated in FIG. 6.

Figure 7:
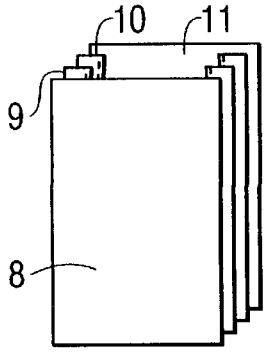

The overall structure of the two-compartment bag is to be seen from FIG. 7. The four sides 8, 9, 10, and 11 superimposed one on another are joined as described above.

I claim:

1. A device for sorting of refuse and household garbage in a receptacle for separate disposal comprising:

at least two sackshaped compartments made of walls of sheet material, said walls including, for each compartment, an external wall and an internal wall adjacent to the internal wall of the other compartment;

means for joining the compartments to each other so as to be separable, wherein the sackshaped compartments (3, 4) are joined to each other by a transition portion extending upward to a common upper area (2) and in the upper area (5) the adjacent internal walls each have an upper end defining a recess and an edge, only the internal walls being connected to each other along the edges of their upper ends at the recesses.

2. A device as claimed in claim 1, wherein the common area flares outward.

3. A device as claimed in claim 1, wherein the common area is circular in cross-section.

4. A device as claimed in claim 1, wherein a tear seam extends through the upper ends of the internal walls at their edges at the recesses.

5. A device as claimed in claim 1, wherein the compartments are unattached below the edges of the upper ends of the internal walls.

* * * * *

UNITED STATES PATENT AND TRADEMARK OFFICE

CERTIFICATE OF CORRECTION

PATENT NO. : 6,036,363

DATED : March 14, 2000

INVENTOR(S) : Florian Behnk

It is certified that error appears in the above-indentified patent and that said Letters Patent is hereby corrected as shown below: On the title page:

item [76], line 1, "Krieckamp" should read "Krietkamp"

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*